US007892150B1

(12) United States Patent
Colley

(10) Patent No.: US 7,892,150 B1
(45) Date of Patent: Feb. 22, 2011

(54) COMBINED TREADMILL AND SEAT ASSEMBLY FOR PHYSICALLY IMPAIRED USERS AND ASSOCIATED METHOD

(76) Inventor: George L. Colley, 19326 Snowden St., Detroit, MI (US) 48235

( * ) Notice: Subject to any disclaimer, the term of this patent is extended or adjusted under 35 U.S.C. 154(b) by 0 days.

(21) Appl. No.: 12/574,874

(22) Filed: Oct. 7, 2009

(51) Int. Cl.
*A63B 22/02* (2006.01)

(52) U.S. Cl. ..... 482/54; 434/255

(58) Field of Classification Search ..... 482/51, 482/54, 111, 112, 114, 115, 121, 122, 126, 482/129; 434/247, 255; 601/5, 23, 35
See application file for complete search history.

(56) References Cited

U.S. PATENT DOCUMENTS 3,193,287 A * 7/1965 Robinson ..... 482/54
4,625,962 A * 12/1986 Street ..... 482/116
4,869,493 A * 9/1989 Johnston ..... 482/54
5,224,909 A 7/1993 Hamilton
5,429,563 A 7/1995 Engel
5,492,521 A 2/1996 Wilkinson
5,626,539 A 5/1997 Plaget
5,669,856 A 9/1997 Liu
5,830,113 A * 11/1998 Coody et al. ..... 482/54
5,860,894 A * 1/1999 Dalebout et al. ..... 482/54
D406,621 S 3/1999 Piaget
5,921,892 A 7/1999 Easton
5,951,449 A * 9/1999 Oppriecht ..... 482/113
6,033,347 A 3/2000 Dalebout
6,443,875 B1 9/2002 Golen, Jr.
6,821,233 B1 * 11/2004 Colombo et al. ..... 482/54
2006/0247109 A1 * 11/2006 Powell ..... 482/148
2008/0194389 A1 * 8/2008 Southerland ..... 482/54

* cited by examiner

*Primary Examiner*—Loan Thanh
*Assistant Examiner*—Tam Nguyen

(57) ABSTRACT

A combined treadmill and seat assembly includes a portable treadmill, and a portable seat assembly detachably connected to the treadmill such that the seat assembly is selectively disposed between first and second positions while connected to the treadmill. The seat assembly includes first and second seats oriented at oppositely facing axial directions so that the first seat extends towards the treadmill while the second seat extends away from the treadmill. Advantageously, the treadmill platform is registered along a first plane when the seat assembly is positioned at the first position and, the treadmill platform is registered along a second plane when the seat assembly is positioned at the second position. Notably, the first and second planes are horizontally oriented and coplanar such that the treadmill platform remains equidistantly spaced from a ground surface when the seat assembly is situated at the first and second positions respectively.

15 Claims, 6 Drawing Sheets

COMBINED TREADMILL AND SEAT ASSEMBLY FOR PHYSICALLY IMPAIRED USERS AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to treadmills and, more particularly, to a combined treadmill and seat assembly for allowing physically impaired users to exercise without any assistance from a physical therapist.

2. Prior Art

Treadmills have become increasingly popular in recent years as a piece of exercise equipment. Treadmills can be used for either running or walking indoors such as in the home or office. Most exercise treadmills include an exercise platform that includes an elongated frame with a first and second roller assembly mounted across opposite lateral ends of the frame. An endless belt is mounted for travel about the roller assemblies. The belt is flexible for supporting the weight of the user. A deck that is disposed between the upper portion of the belt and the frame usually supports the belt. The deck is usually made of rigid material. A motor controls the belt. As the user walks or runs on the belt, the belt is pressed against the underlying deck to provide mechanical support for a user.

Conventional treadmills require a user to walk on the treadmill belt with both feet. This requires a user to exercise both legs at the same time, rather than exercising one leg at a time. Exercising one leg at a time is beneficial for users undergoing rehabilitation to retrain the muscles in the leg. Further, users recovering from injuries and surgeries, as well as those who may be undergoing physical therapy require treadmills that allow them to exercise one leg at a time for helping them regain strength and improve balance and coordination in the lower extremities.

Accordingly, there exists a need for a combined treadmill and seat assembly that allows a physically impaired user to exercise without assistance from a physical therapist.

BRIEF SUMMARY OF THE INVENTION

In view of the foregoing background, it is therefore an object of the present invention to provide a combined treadmill and seat assembly for assisting a physically impaired user to independently exercise without help from a care giver. These and other objects, features, and advantages of the invention are provided by a combined treadmill and seat assembly including a portable treadmill having a platform rotating along a travel path aligned with a longitudinal length of the treadmill, and a portable seat assembly detachably connected to the treadmill such that the seat assembly is selectively disposed between first and second positions while connected to the treadmill. The seat assembly preferably includes first and second seats oriented at oppositely facing axial directions so that the first seat extends towards the treadmill while the second seat extends away from the treadmill.

Advantageously, the treadmill platform is registered along a first plane when the seat assembly is positioned at the first static position and, the treadmill platform is registered along a second plane when the seat assembly is positioned at the second static position. Notably, the first and second planes are horizontally oriented and coplanar such that the treadmill platform remains equidistantly spaced from a ground surface when the seat assembly is situated at the first and second positions respectively.

In one embodiment, the seat assembly may further include a vertically oriented first anchor shaft, and a horizontally oriented second anchor shaft spaced subjacent to the first anchor shaft. A T-shaped bracket may be statically mated to the second anchor shaft. A swivel-coupling may be connected to the first anchor shaft and the T-shaped bracket such that the first anchor shaft is freely rotated along a 360 degree arcuate path while the second anchor shaft remains statically disposed therebeneath. Also, a latch bolt may be adjustably connected to the swivel-coupling for prohibiting the first anchor shaft from rotating along the 360 degree arcuate path.

In one embodiment, the seat assembly may further include an L-shaped support plate statically coupled directly to a top surface of a proximal end of the second anchor shaft. A rectilinear stabilizing bar may be statically attached directly to a top surface of the L-shaped support plate wherein the rectilinear stabilizing bar is engaged to a bottom surface of the treadmill and spaced below the platform for prohibiting the treadmill and the seat assembly from prematurely shifting apart during operating conditions.

In one embodiment, the seat assembly may further include a plurality of coextensively shaped auxiliary support rods directly attached to a bottom surface of the second anchor shaft wherein such auxiliary support rods are registered orthogonal to the second anchor shaft, respectively. A plurality of wheels may be mated to opposed ends of the auxiliary support rods for easily transporting the seat assembly between remote locations.

In one embodiment, the seat assembly may further include a pair of coextensively shaped rectilinear guide rails directly mated to the bracket and extending radially outward therefrom. A distal end of the treadmill may be directly rested on the guide rails when the seat assembly is disposed at the first position such that the treadmill remains spaced from the guide rails when the seat assembly is disposed at the second position.

In one embodiment, the seat assembly may further include adjustable leg and arm presses mated directly to the second anchor shaft and distally spaced from the treadmill respectively. A pulley-actuated overhead harness is preferably connected to an L-shaped top end of the first anchor shaft and an anchor bracket may be statically mated to the first anchor shaft. An upper body support section may be adjustably connected to a first side of the anchor bracket and a back support rest may be mated to a second side of the anchor bracket. In this manner, the upper body support section is vertically aligned above the first seat and the back support rest is vertically aligned above the second seat.

In one embodiment, the treadmill may further include an upper support stand mated to a proximal end of the platform, a display monitor connected to the upper support stand and a plurality of wheels coupled to a proximal end of the upper support stand.

The present invention may further include a method for utilizing a combined treadmill and seat assembly for assisting a physically impaired user to independently exercise without help from a care giver. Such a method preferably includes the chronological steps of providing a portable treadmill having a platform rotating along a travel path aligned with a longitudinal length of the treadmill; providing and detachably connecting a portable seat assembly to the treadmill by selectively disposing the seat assembly between first and second positions while connected to the treadmill; providing and orienting first and second seats at oppositely facing axial directions so that the first seat extends towards the treadmill while the second seat extends away from the treadmill; registering the treadmill platform along a first plane by positioning the seat assembly at the first static position; registering the treadmill platform along a second plane by positioning the seat assembly at the second static position; and horizontally orienting the first and second planes at a coplanar position such that the treadmill platform remains equidistantly spaced from a ground surface when the seat assembly is situated at the first and second positions respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
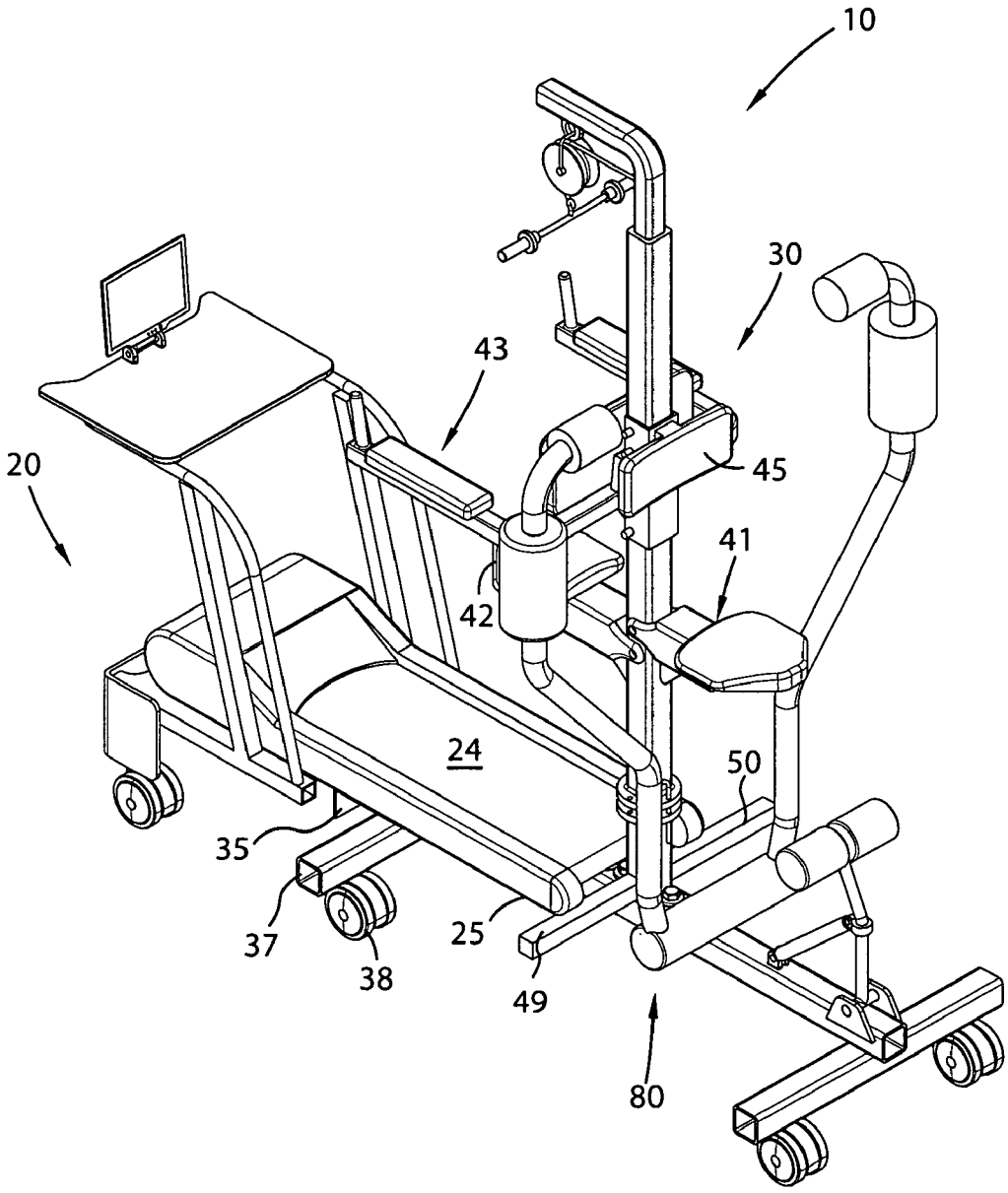
FIG. 1 is a perspective view showing the seat assembly connected in parallel to a longitudinal axis of the treadmill, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-6 by the reference numeral 10 and is intended to provide a combined treadmill and seat assembly for allowing a physically impaired user to exercise without assistance from a care giver. It should be understood that the combined treadmill and seat assembly 10 may be used to by many physically impaired users that are recovering from a variety of ailments including leg, back and arm ailments.

Figure 2:
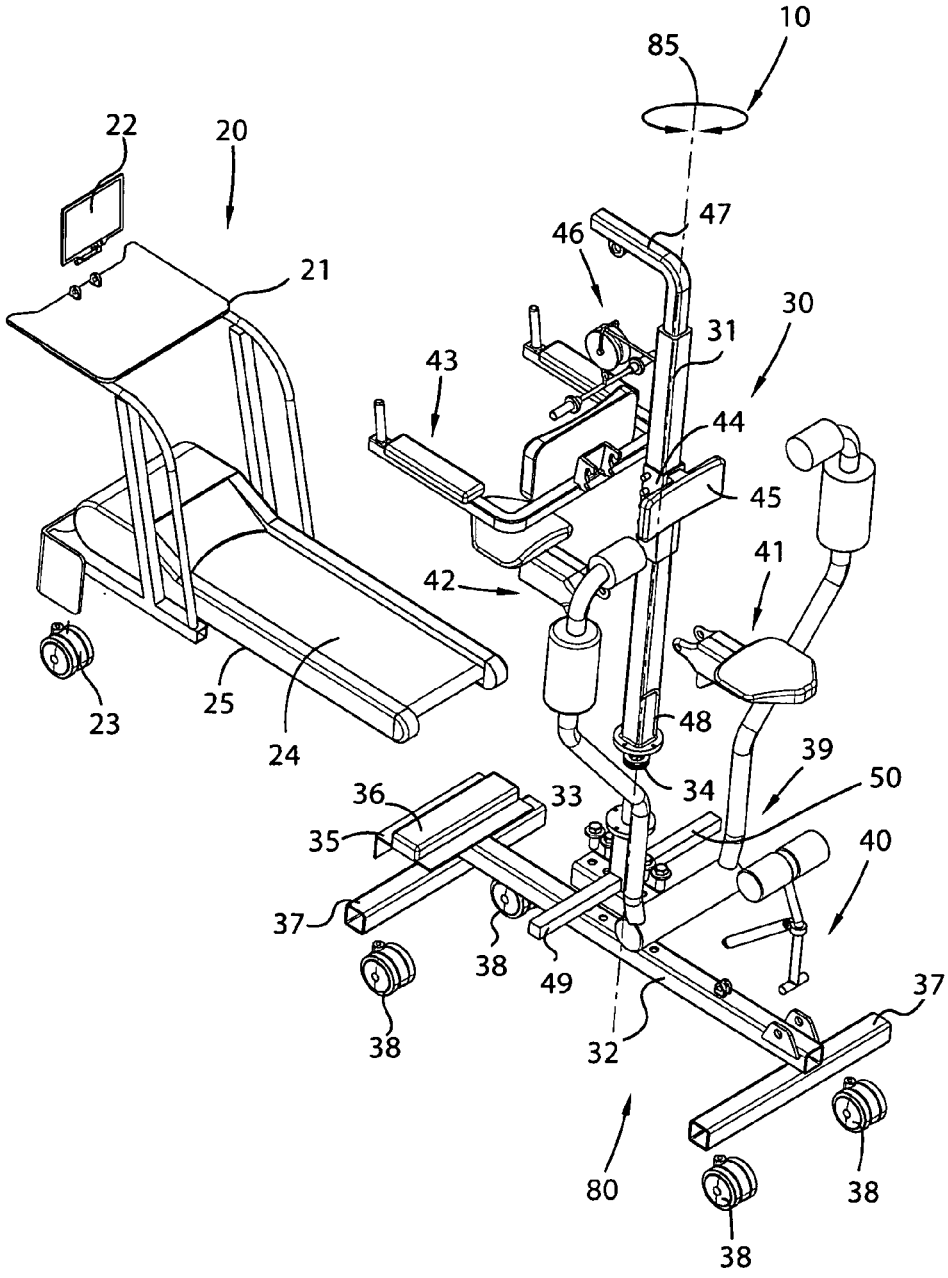
FIG. 2 is an exploded view of FIG. 1.
Figure 3:
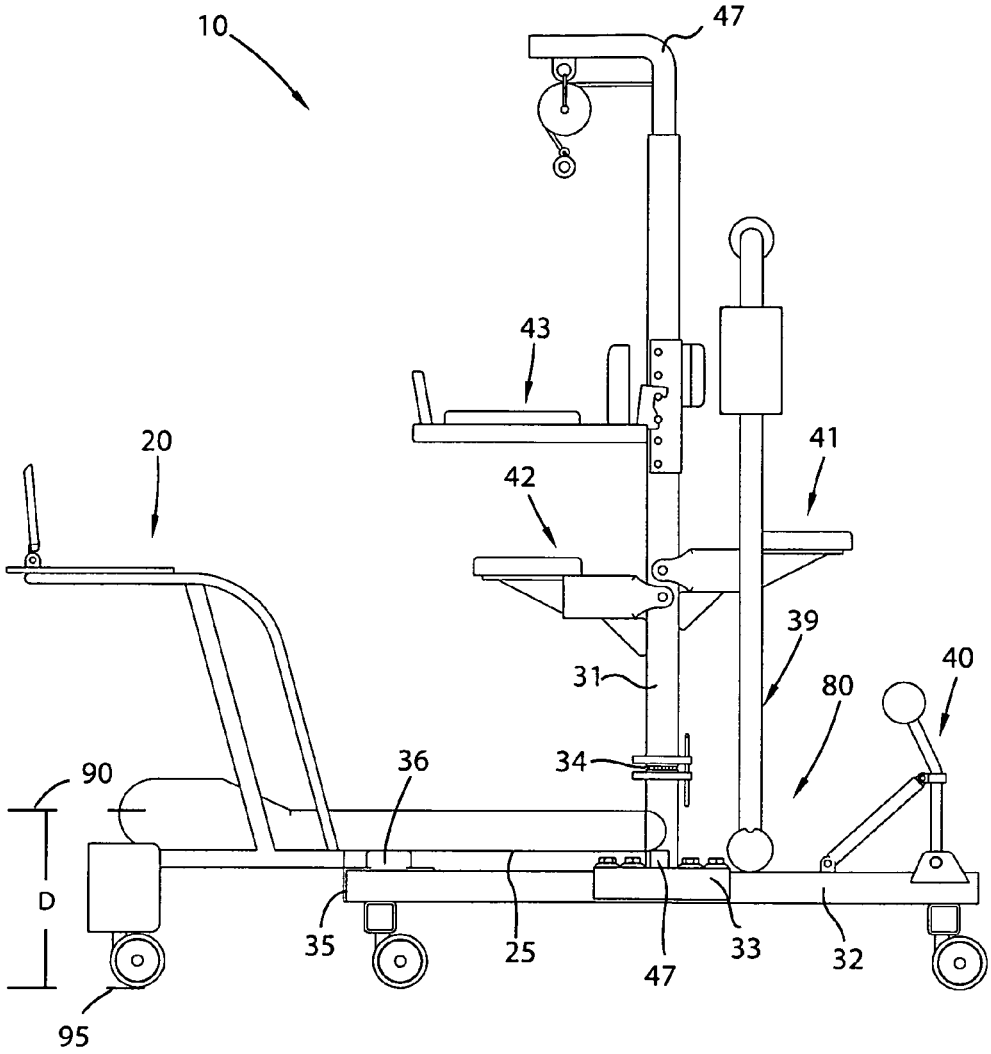
FIG. 3 is a side elevational view of FIG. 1.
Figure 4:
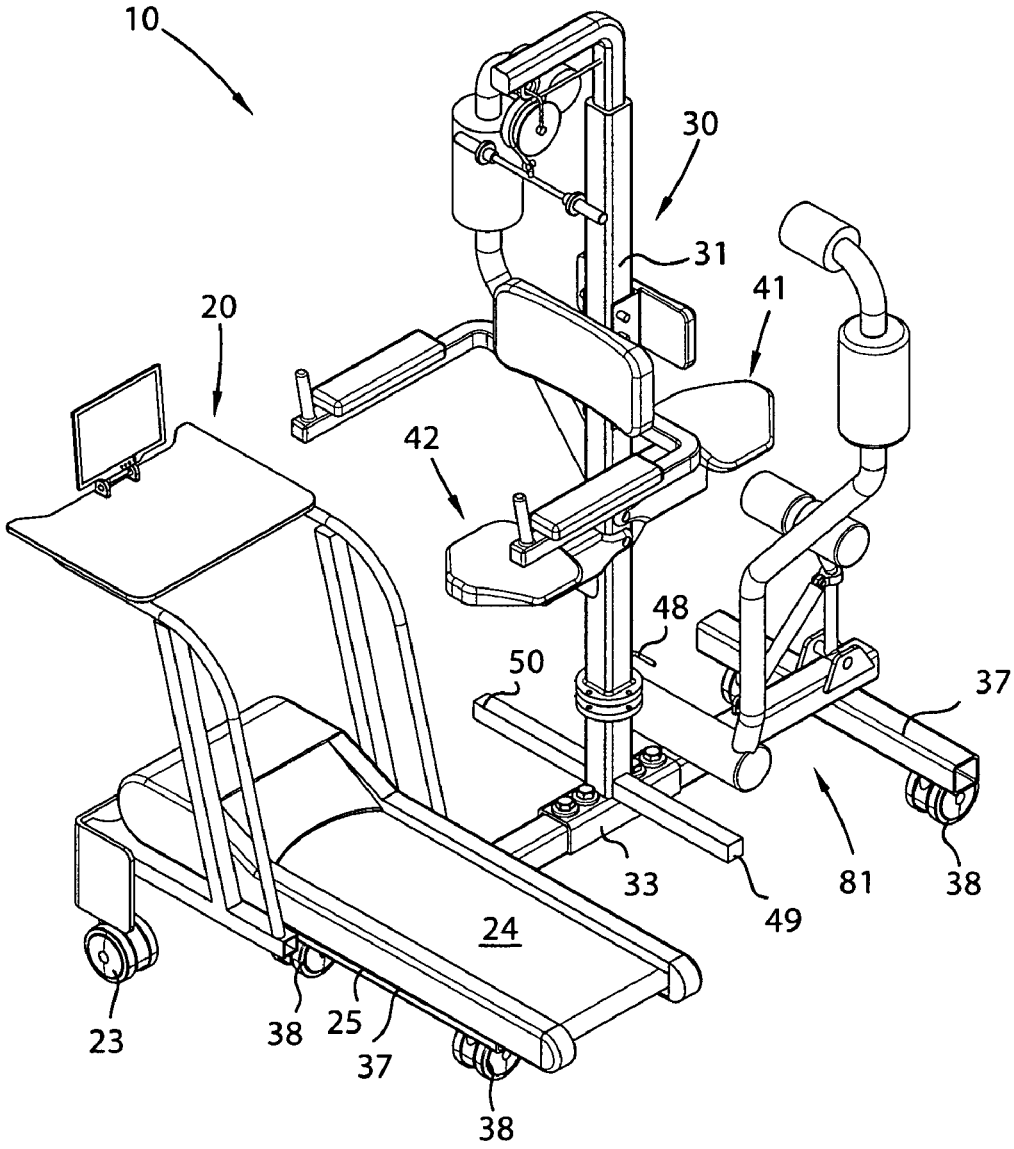
FIG. 4 is a perspective view showing the seat assembly connected orthogonally to the longitudinal axis of the treadmill.
Figure 5:
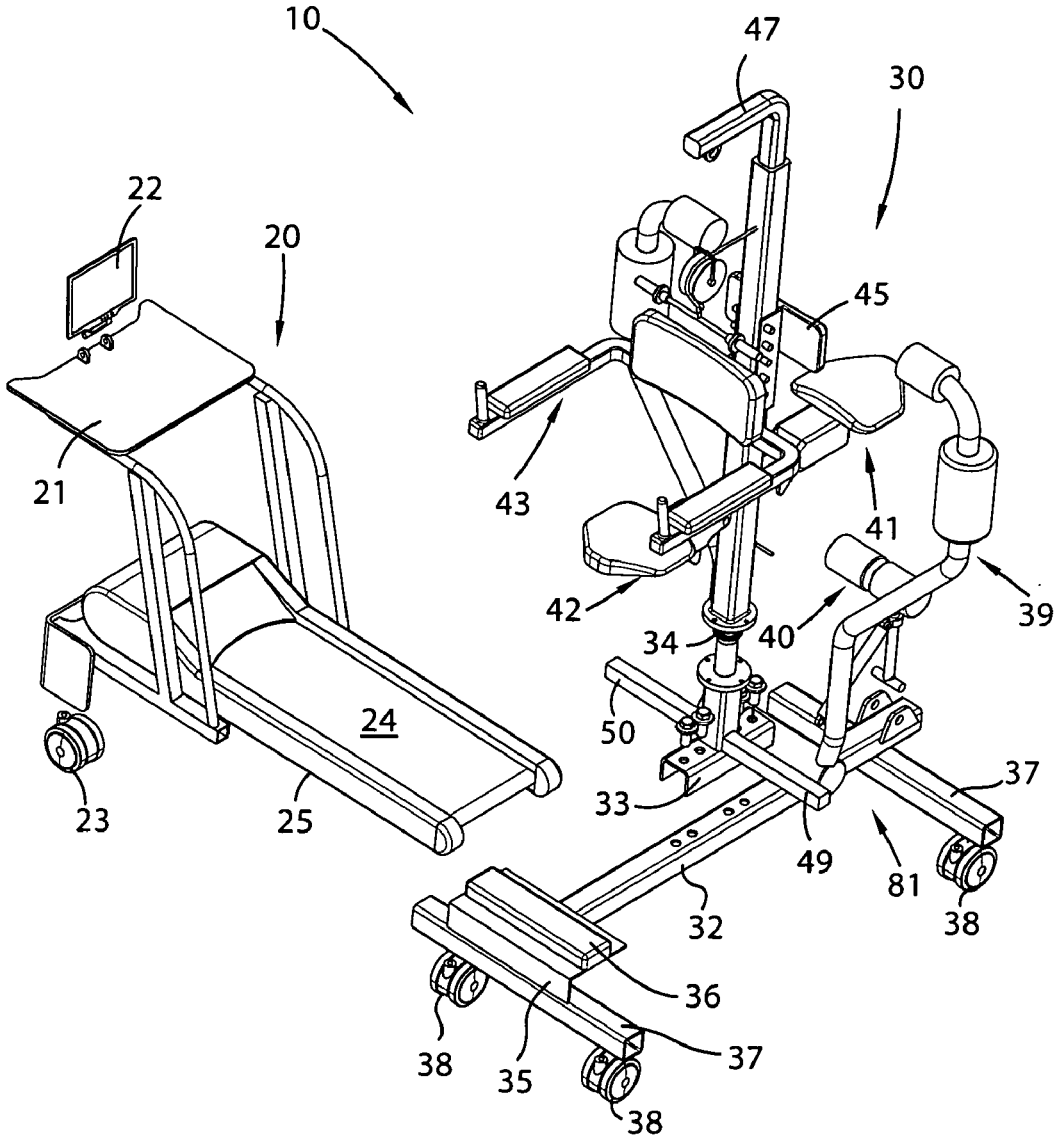
FIG. 5 is an exploded view of FIG. 4.
Figure 6:
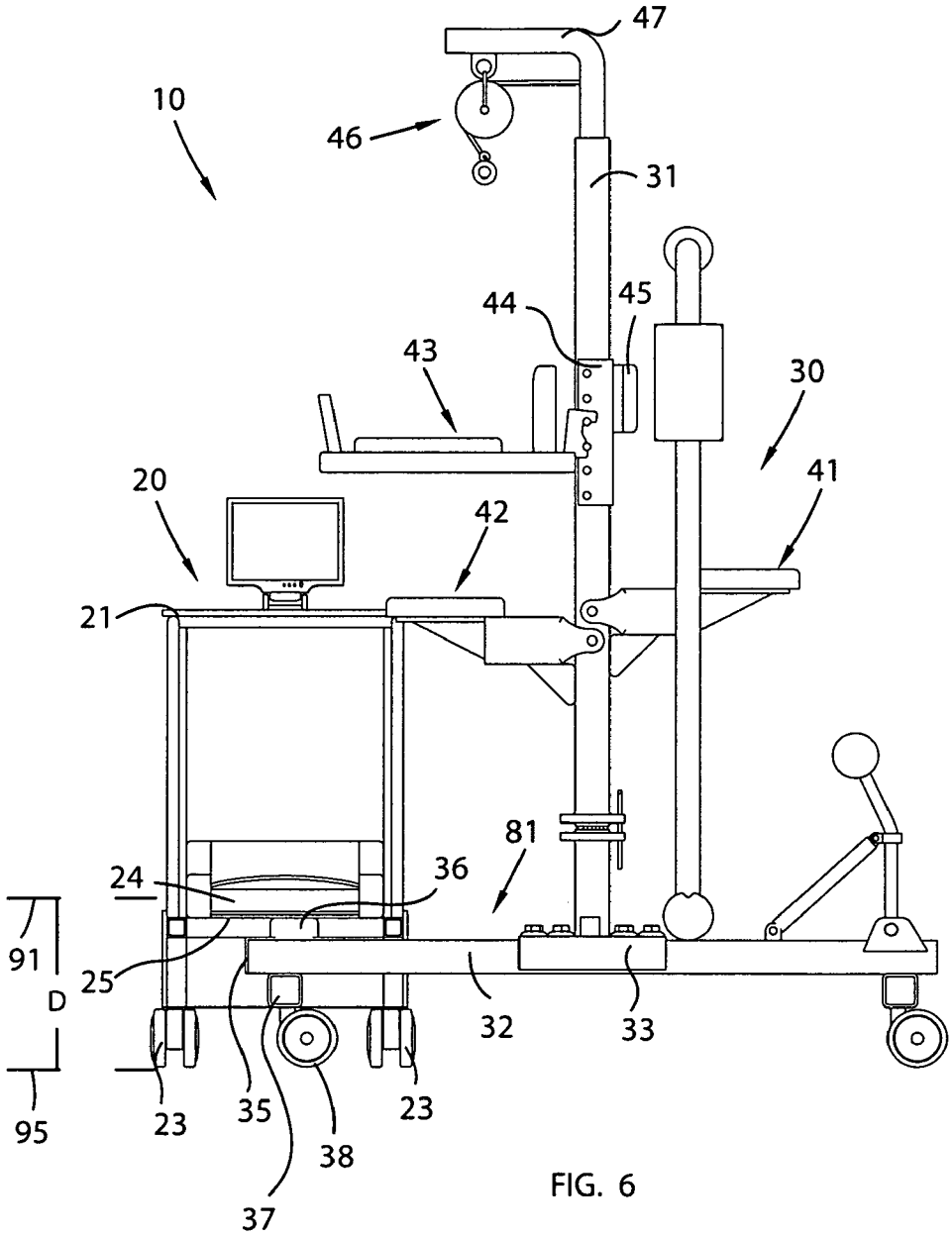
FIG. 6 is a side elevational view of FIG. 4.

The combined treadmill and seat assembly 10 preferably includes a portable treadmill 20 having a platform 24 rotating along a travel path aligned with a longitudinal length of the treadmill 20, and a portable seat assembly 30 detachably connected to the treadmill 20 such that the seat assembly 30 is selectively disposed between first 80 and second positions 81 while connected to the treadmill 20. The seat assembly 30 preferably includes first 42 and second 41 seats oriented at oppositely facing axial directions so that the first seat 42 extends towards the treadmill 20 while the second seat 41 extends away from the treadmill 20. The first position 80 of seat assembly 30 is best shown in FIGS. 1-3 and the second position 81 of seat assembly 30 is best shown in FIGS. 4-6. The combination of such claimed elements allows the physically impaired user to easily change positions when performing different exercises on the treadmill 20 and arm/leg/back presses 39, 40, 43 without having to travel to a different exercise machine remotely located from the treadmill.

Advantageously, the treadmill platform 24 is registered along a first plane 90 when the seat assembly 30 is positioned at the first position 80 and, the treadmill 20 platform 24 is registered along a second plane 91 when the seat assembly 30 is positioned at the second position 81. Notably, the first 90 and second 91 planes are horizontally oriented and coplanar such that the treadmill platform 24 remains equidistantly spaced from a ground surface 95 when the seat assembly 30 is situated at the first 80 and second 81 positions, respectively. FIGS. 3 and 6 show the equidistant distance D, between planes 90, 91 to ground surface 95, respectively. The combination of such claimed elements solves the problem of having to continuously readjust the slope of the treadmill 20 when repositioning the seat assembly 30 between the first 80 and second 81 positions.

The seat assembly 30 may further include a vertically oriented first anchor shaft 31, and a horizontally oriented second anchor shaft 32 spaced subjacent to the first anchor shaft 31. A T-shaped bracket 33 may be statically mated to the second anchor shaft 32. As perhaps best shown in FIG. 2, a swivel-coupling 34 may be connected to the first anchor shaft 31 and the T-shaped bracket 33 such that the first anchor shaft 31 is freely rotated along a 360 degree arcuate path 85 while the second anchor shaft 32 remains statically disposed therebeneath. Also, a latch bolt 48 may be adjustably connected to the swivel-coupling 34 for prohibiting the first anchor shaft 31 from rotating along the 360 degree arcuate path 85. The combination of such claimed elements allows the physically impaired user to rotate the first anchor shaft 31 away from the treadmill 20 when getting on/off the seat. This feature ensures the physically impaired user will not be injured when transitioning between the treadmill 20 and arm/leg press exercises.

The seat assembly 30 may further include an L-shaped support plate 35 statically coupled directly to a top surface of a proximal end of the second anchor shaft 32. A rectilinear stabilizing bar 36 may be statically attached directly to a top surface of the L-shaped support plate 35 wherein the rectilinear stabilizing bar 36 is engaged to a bottom surface 25 of treadmill 20 and spaced below platform 24 for prohibiting the treadmill 20 and the seat assembly 30 from prematurely shifting apart during operating conditions. The combination of such claimed elements solves the problem of undesirable tilting and shifting of treadmill 20 during operating conditions, which provides an unpredictable and unexpected result which is not rendered obvious by one skilled in the art.

The seat assembly 30 may further include a plurality of coextensively shaped auxiliary support rods 37 directly attached to a bottom surface of the second anchor shaft 32 wherein such auxiliary support rods 37 are registered orthogonal to the second anchor shaft 32, respectively. A plurality of wheels 38 may be mated to opposed ends of the auxiliary support rods 37 for easily transporting the seat assembly 30 between remote locations.

The seat assembly 30 may further include a pair of coextensively shaped rectilinear guide rails 49, 50 directly mated to the T-shaped bracket and extending radially outward therefrom. A distal end of the treadmill 20 may be directly rested on the guide rails 49, 50 when the seat assembly 30 is disposed at the first position 80 such that the treadmill 20 remains spaced from the guide rails 49, 50 when the seat assembly 30 is disposed at the second position 81. The combination of such claimed elements ensures the treadmill platform 24 remains spaced above the second anchor shaft 32 and thereby freely rotate as needed.

In one embodiment, the seat assembly 30 may further include adjustable arm and leg presses 39, 40 mated directly to the second anchor shaft 32 and distally spaced from the treadmill 20, respectively. A pulley-actuated overhead harness 46 may be connected to an L-shaped top end 47 of the first anchor shaft 31 and an anchor bracket 44 may be statically mated to the first anchor shaft 31. An upper body support section 43 may be adjustably connected to a first side of the anchor bracket 44 and a back support rest 45 may be mated to a second side of the anchor bracket 44. In this manner, the upper body support section 43 is vertically aligned above the first seat 42 and the back support rest 45 is vertically aligned above the second seat 41. The combination of such claimed elements allows the physically impaired user to conveniently switch between different exercises without having to reposition the seat, which provides an unpredictable and unexpected result which is not rendered obvious by one skilled in the art.

In one embodiment, the treadmill 20 may further include an upper support stand 21 mated to a proximal end of the platform 24, a display monitor 22 connected to the upper support stand 21 and a plurality of wheels 23 coupled to a proximal end of the upper support stand 21.

The present invention may further include a method for utilizing a combined treadmill and seat assembly 10 for assisting a physically impaired user to independently exercise without help from a care giver. Such a method preferably includes the chronological steps of providing a portable treadmill 20 having a platform 24 rotating along a travel path aligned with a longitudinal length of the treadmill 20; providing and detachably connecting a portable seat assembly 30 to the treadmill 20 by selectively disposing the seat assembly 30 between first 80 and second positions 81.

The method may further include the chronological steps of: providing and orienting first 42 and second 41 seats at oppositely facing axial directions so that the first seat 42 extends towards the treadmill 20 while the second seat 41 extends away from the treadmill 20; registering the treadmill platform 24 along a first plane 90 by positioning the seat assembly 30 at the first position 80; registering the treadmill platform 24 along a second plane 91 by positioning the seat assembly 30 at the second position 81; and horizontally orienting the treadmill platform at first 90 and second 91 planes that are coplanar such that the treadmill platform 24 remains equidistantly spaced from a ground surface 95 when the seat assembly 30 is situated at the first 80 and second 81 positions, respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined treadmill and seat assembly for assisting a physically impaired user to independently exercise without help from a care giver, said combined treadmill and seat assembly comprising:

a treadmill having a platform and a longitudinal axis that extends from front to back of said treadmill; and a seat assembly, adapted to support a seated user, being adjustably to said treadmill such that said seat assembly is selectively disposed between first and second positions in connection to said treadmill;

wherein said seat assembly includes first and second seats oriented at oppositely facing axial directions so that said first seat extends towards said treadmill while said second seat extends away from said treadmill;

wherein said treadmill platform is disposed along a first plane when said seat assembly is positioned at said first position that is coaxial to the longitudinal axis of the treadmill; and;

wherein said treadmill platform is disposed along a second plane when said seat assembly is positioned at said second position that is orthogonal to the longitudinal axis of the treadmill.

2. The combined treadmill and seat assembly of claim 1, wherein said seat assembly further comprises:

a vertically oriented first anchor shaft;

a horizontally oriented second anchor shaft spaced subjacent to said first anchor shaft;

a T-shaped bracket statically mated to said second anchor shaft;

a swivel-coupling connected to said first anchor shaft and said T-shaped bracket such that said first anchor shaft is freely rotated 360 degrees while said second anchor shaft remains statically disposed therebeneath; and a latch bolt adjustably connected to said swivel-coupling for prohibiting said first anchor shaft from rotating.

3. The combined treadmill and seat assembly of claim 2, wherein said seat assembly further comprises:

an L-shaped support plate statically coupled directly to a top surface of a proximal end of said second anchor shaft; and a rectilinear stabilizing bar statically attached directly to a top surface of said L-shaped support plate;

wherein said rectilinear stabilizing bar is engaged to a bottom surface of said treadmill and spaced below said platform for prohibiting said treadmill and said seat assembly from prematurely shifting apart during operating conditions.

4. The combined treadmill and seat assembly of claim 1, wherein said seat assembly further comprises:

a plurality of coextensively shaped auxiliary support rods directly attached to a bottom surface of said second anchor shaft and being disposed orthogonal thereto respectively; and a plurality of wheels mated to opposed ends of said auxiliary support rods.

5. The combined treadmill and seat assembly of claim 2, wherein said seat assembly further comprises:

a pair of coextensively shaped rectilinear guide rails directly mated to said T-shaped bracket and extending radially outward therefrom, a distal end of said treadmill being directly rested on said guide rails when said seat assembly is disposed at said first position, said treadmill remaining spaced from said guide rails when said seat assembly is disposed at said second position.

6. The combined treadmill and seat assembly of claim 3, wherein said seat assembly further comprises:

adjustable leg and arm presses mated directly to said second anchor shaft and distally spaced from said treadmill respectively;

a pulley-actuated overhead harness connected to an L-shaped top end of said first anchor shaft;

an anchor bracket statically mated to said first anchor shaft;

an upper body support section adjustably connected to a first side of said anchor bracket; and a back support rest mated to a second side of said anchor bracket;

wherein said upper body support section is vertically aligned above said first seat;

wherein said back support rest is vertically aligned above said second seat.

7. The combined treadmill and seat assembly of claim 1, wherein said treadmill further comprises:

an upper support stand mated to a proximal end of said platform;

a display monitor connected to said upper support stand; and a plurality of wheels coupled to a proximal end of said upper support stand.

8. A combined treadmill and seat assembly for assisting a physically impaired user to independently exercise without help from a care giver, said combined treadmill and seat assembly comprising:

a portable treadmill having a platform and a longitudinal axis that extends from front to back of said treadmill; and a portable seat assembly, adapted to support a seated user, being adjustably to said treadmill such that said seat assembly is selectively disposed between first and second positions in connection to said treadmill;

wherein said seat assembly includes first and second seats oriented at oppositely facing axial directions so that said first seat extends towards said treadmill while said second seat extends away from said treadmill;

wherein said treadmill platform is disposed along a first plane when said seat assembly is positioned at said first position that is coaxial to the longitudinal axis of the treadmill; and;

wherein said treadmill platform is disposed along a second plane when said seat assembly is positioned at said second position that is orthogonal to the longitudinal axis of the treadmill.

9. The combined treadmill and seat assembly of claim 8, wherein said seat assembly further comprises:

a vertically oriented first anchor shaft;

a horizontally oriented second anchor shaft spaced subjacent to said first anchor shaft;

a T-shaped bracket statically mated to said second anchor shaft;

a swivel-coupling connected to said first anchor shaft and said T-shaped bracket such that said first anchor shaft is freely rotated 360 degrees while said second anchor shaft remains statically disposed therebeneath; and a latch bolt adjustably connected to said swivel-coupling for prohibiting said first anchor shaft from rotating.

10. The combined treadmill and seat assembly of claim 9, wherein said seat assembly further comprises:

an L-shaped support plate statically coupled directly to a top surface of a proximal end of said second anchor shaft; and a rectilinear stabilizing bar statically attached directly to a top surface of said L-shaped support plate;

wherein said rectilinear stabilizing bar is engaged to a bottom surface of said treadmill and spaced below said platform for prohibiting said treadmill and said seat assembly from prematurely shifting apart during operating conditions.

11. The combined treadmill and seat assembly of claim 8, wherein said seat assembly further comprises:

a plurality of coextensively shaped auxiliary support rods directly attached to a bottom surface of said second anchor shaft and being disposed orthogonal thereto respectively; and a plurality of wheels mated to opposed ends of said auxiliary support rods.

12. The combined treadmill and seat assembly of claim 9, wherein said seat assembly further comprises:

a pair of coextensively shaped rectilinear guide rails directly mated to said T-shaped bracket and extending radially outward therefrom, a distal end of said treadmill being directly rested on said guide rails when said seat assembly is disposed at said first position, said treadmill remaining spaced from said guide rails when said seat assembly is disposed at said second position.

13. The combined treadmill and seat assembly of claim 10, wherein said seat assembly further comprises:

adjustable leg and arm presses mated directly to said second anchor shaft and distally spaced from said treadmill respectively;

a pulley-actuated overhead harness connected to an L-shaped top end of said first anchor shaft;

an anchor bracket statically mated to said first anchor shaft;

an upper body support section adjustably connected to a first side of said anchor bracket; and a back support rest mated to a second side of said anchor bracket;

wherein said upper body support section is vertically aligned above said first seat;

wherein said back support rest is vertically aligned above said second seat.

14. The combined treadmill and seat assembly of claim 8, wherein said treadmill further comprises:

an upper support stand mated to a proximal end of said platform;

a display monitor connected to said upper support stand; and a plurality of wheels coupled to a proximal end of said upper support stand.

15. A method for utilizing a combined treadmill and seat assembly for assisting a physically impaired user to independently exercise without help from a care giver, said method comprising the chronological steps of:

providing a portable treadmill having a platform and a axis that extends from front to back of said treadmill;

providing and adjustably connecting a portable seat assembly, having first and second seats adapted to support a seated user, a pulley actuated harness assembly, a leg press and an arm press, to said treadmill by selectively disposing said seat assembly between first and second positions;

wherein the first and second seats are disposed oppositely facing axial directions so that said first seat extends towards said treadmill while said second seat extends away from said treadmill;

moving said treadmill platform along a first plane by positioning said seat assembly at said first position that is coaxial to the longitudinal axis of the treadmill;

moving said treadmill platform along a second plane by positioning said seat assembly at said second position that is orthogonal to the longitudinal axis of the treadmill; and engaging the first seat to exercise a user's legs on the treadmill and user's arms with the pulley assembly or engaging the second seat to exercise a user's arms and legs with the arm press and leg press respectively.

* * * * *